US010006250B2

(12) United States Patent
Winslow et al.

(10) Patent No.: US 10,006,250 B2
(45) Date of Patent: Jun. 26, 2018

(54) DIRECTIONAL CONTROL OF A ROTARY STEERABLE DRILLING ASSEMBLY USING A VARIABLE FLUID FLOW PATHWAY

(71) Applicant: Halliburton Energy Services, Inc., Houston, TX (US)

(72) Inventors: Daniel Winslow, Spring, TX (US); Neelesh Deolalikar, Webster, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 201 days.

(21) Appl. No.: 14/653,036

(22) PCT Filed: Dec. 21, 2012

(86) PCT No.: PCT/US2012/071292

§ 371 (c)(1),
(2) Date: Jun. 17, 2015

(87) PCT Pub. No.: WO2014/098900

PCT Pub. Date: Jun. 26, 2014

(65) Prior Publication Data

US 2015/0330149 A1 Nov. 19, 2015

(51) Int. Cl.
*E21B 7/08* (2006.01)
*E21B 7/06* (2006.01)
(Continued)

(52) U.S. Cl.
CPC ..... *E21B 7/06* (2013.01); *E21B 3/00* (2013.01); *E21B 4/02* (2013.01); *E21B 4/04* (2013.01);
(Continued)

(58) Field of Classification Search
CPC ..... E21B 7/06; E21B 7/062; E21B 7/068
See application file for complete search history.

(56) References Cited

U.S. PATENT DOCUMENTS 6,092,610 A 7/2000 Kosmala et al.
2002/0175003 A1 11/2002 Pisoni et al.
2009/0272533 A1* 11/2009 Burns ..... C10G 21/22 166/272.7

FOREIGN PATENT DOCUMENTS

CN 1299915 A 6/2001
CN 1853029 A 10/2006
(Continued)

OTHER PUBLICATIONS

Office Action issued in related Chinese application No. 201280077257.6, dated Feb. 3, 2016, 16 pages (translated).
(Continued)

*Primary Examiner* — John J Kreck
(74) *Attorney, Agent, or Firm* — Alan Bryson; Baker Botts L.L.P.

(57) ABSTRACT

According to aspects of the present disclosure, systems and methods for controlling the direction of a drilling assembly within a borehole are described herein. An example system may include a housing 201 *b* (FIG. 2B) and a variable flow fluid pathway 203 (FIG. 2B) within the housing 201*b*. A fluid-controlled drive mechanism 209 (FIG. 2C) may be in fluid communication with the variable flow fluid pathway 203. Additionally, an offset mandrel 212 may be coupled to an output of the fluid-controlled drive mechanism 209. The offset mandrel 212 may be independently rotatable with respect to the housing 201*b*. The system may also include a bit shaft 216 pivotably coupled to the housing 201*b* and coupled to an eccentric receptacle of the offset mandrel 212.

18 Claims, 6 Drawing Sheets

(51) Int. Cl.

| | |
|---|---|
| ***E21B 3/00*** | (2006.01) |
| ***E21B 4/02*** | (2006.01) |
| ***E21B 4/04*** | (2006.01) |
| ***E21B 21/10*** | (2006.01) |

(52) U.S. Cl.
CPC ..... *E21B 7/062* (2013.01); *E21B 7/067* (2013.01); *E21B 7/068* (2013.01); *E21B 21/10* (2013.01)

(56) References Cited

FOREIGN PATENT DOCUMENTS

| | | | |
|---|---|---|---|
| CN | 102400644 | A | 4/2012 |
| GB | 2450498 | A | 12/2008 |

OTHER PUBLICATIONS

International Preliminary Report on Patentability issued in related PCT Application No. PCT/US2012/071292, dated Jul. 2, 2015 (10 pages).
International Search Report and Written Opinion issued in related PCT Application No. PCT/US2012/071292 dated Nov. 25, 2013, 14 pages.

* cited by examiner

DIRECTIONAL CONTROL OF A ROTARY STEERABLE DRILLING ASSEMBLY USING A VARIABLE FLUID FLOW PATHWAY

CROSS-REFERENCE TO RELATED APPLICATION

The present application is a U.S. National Stage Application of International Application No. PCT/US2012/071292 filed Dec. 21, 2012, which is incorporated herein by reference in its entirety for all purposes.

BACKGROUND

The present disclosure relates generally to well drilling operations and, more particularly, to directional control of a rotary steerable drilling assembly using a variable flow pathway.

As well drilling operations become more complex, and hydrocarbon reservoirs more difficult to reach, the need to precisely locate a drilling assembly—both vertically and horizontally—in a formation increases. Part of this operation requires steering the drilling assembly, either to avoid particular formations or to intersect formations of interest. Steering the drilling assembly includes changing the direction in which the drilling assembly/drill bit is pointed. Current mechanisms for steering the drilling assembly are typically complex and expensive, and may require engagement of the borehole with extendable engagement mechanisms that can be problematic when they must pass through important mechanisms, such as blowout preventers, that can be crucial for safety during drilling operations.

FIGURES

Some specific exemplary embodiments of the disclosure may be understood by referring, in part, to the following description and the accompanying drawings.

Figure 1:
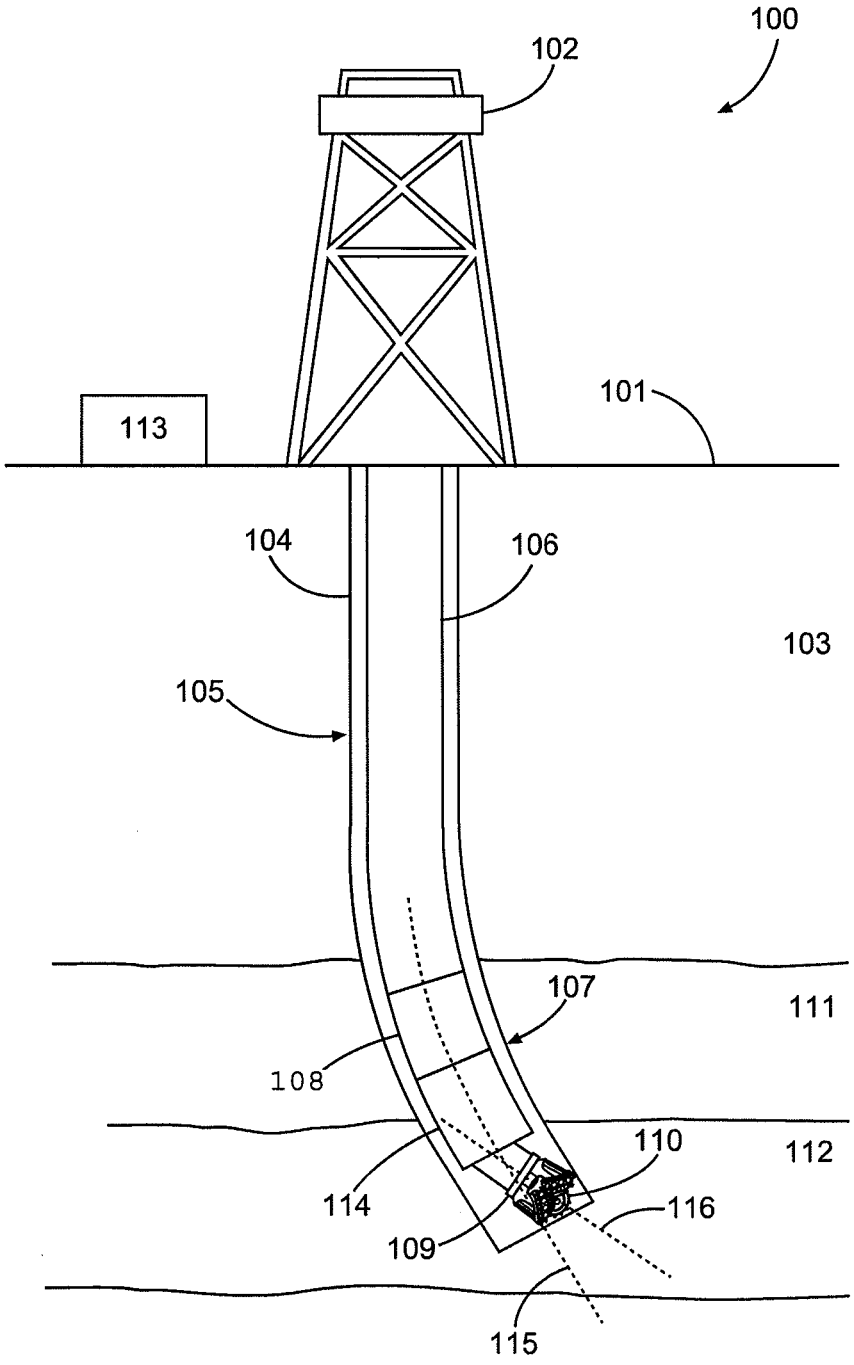

FIG. 1 is a diagram illustrating an example drilling system, according to aspects of the present disclosure.

FIGS. 2A-D are diagrams illustrating an example steering assembly, according to aspects of the present disclosure.

Figure 3A:
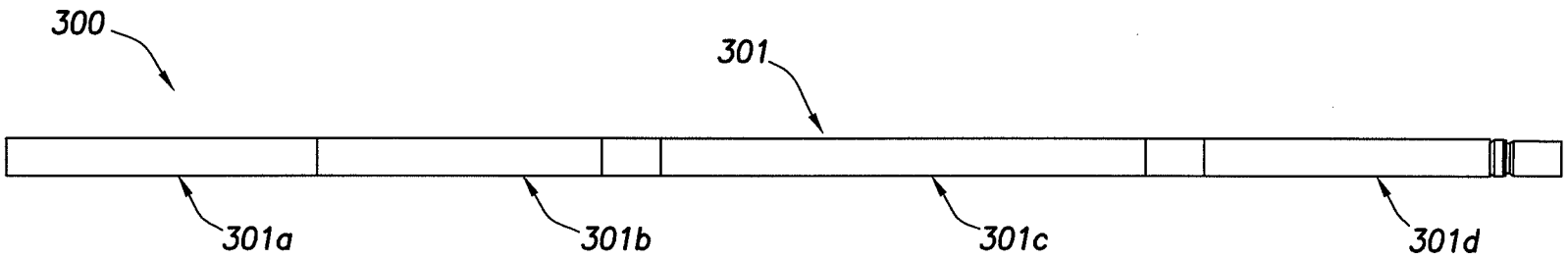
Figure 3B:
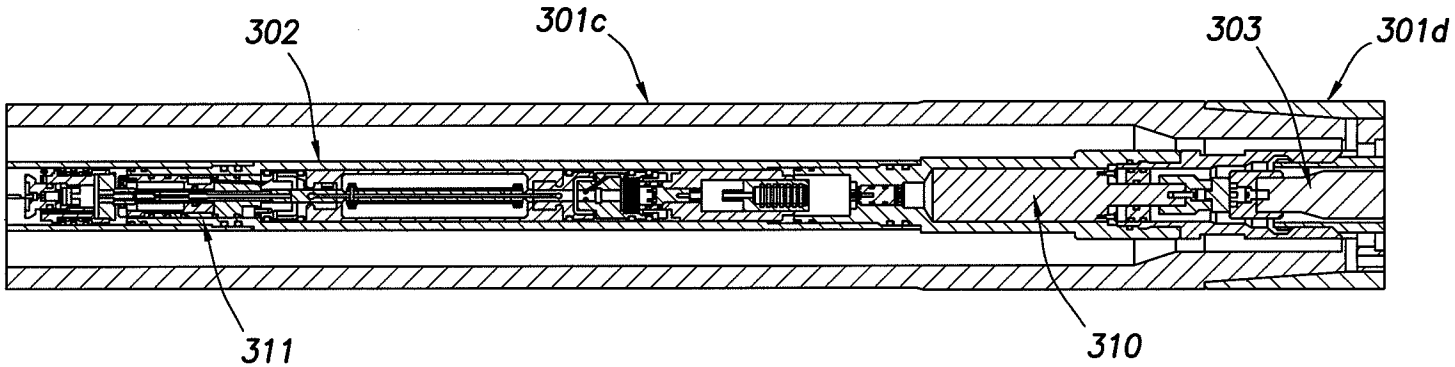
Figure 3C:
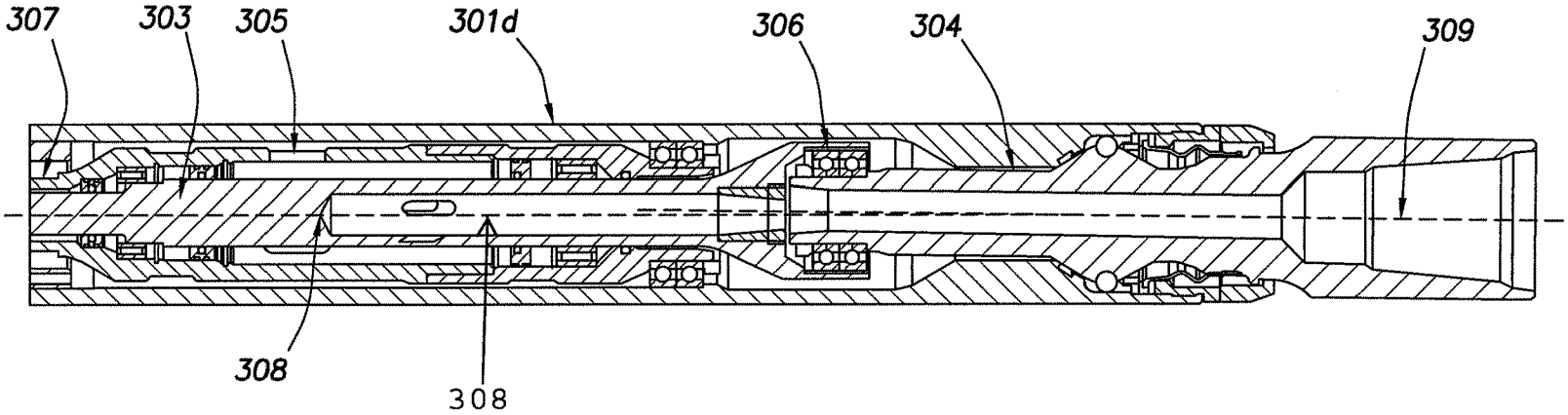

FIGS. 3A-C are diagrams illustrating an example steering, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to directional control of a rotary steerable drilling assembly using a variable flow pathway.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

According to aspects of the present disclosure, systems and methods for controlling the direction of a drilling assembly within a borehole are described herein. An example system may comprise a housing and a variable flow fluid pathway within the housing. A fluid-controlled drive mechanism may be in fluid communication with the variable flow fluid pathway. Additionally, an offset mandrel may be coupled to an output of the fluid-controlled drive mechanism. The offset mandrel may be independently rotatable with respect to the housing. In certain embodiments, the system may also include a bit shaft pivotably coupled to the housing. The bit shaft may be coupled to an eccentric receptacle of the offset mandrel, and the housing may be configured to impart torque on the bit shaft. As will be described below, the bit shaft may be coupled to a drill bit, and the torque imparted on the bit shaft by the housing may drive the drill bit. The fluid-controlled drive mechanism may counter-rotate the offset mandrel with respect to the housing, which may maintain an angular orientation of the offset mandrel, bit shaft, and drill bit with respect to the surrounding formation during drilling operations. The counter-rotation speed of the offset mandrel may be varied by controlling the speed of the fluid-controlled drive mechanism. The speed of the fluid-controlled drive mechanism may be controlled by varying a flow of drilling fluid within the variable flow pathway, with which the flow-controlled drive mechanism is in fluid communication.

FIG. 1 is a diagram illustrating an example drilling system 100, according to aspects of the present disclosure. The drilling system 100 includes rig 102 mounted at the surface 101 and positioned above borehole 104 within a subterranean formation 103. In the embodiment shown, a drilling assembly 105 may be positioned within the borehole 104 and may be coupled to the rig 102. The drilling assembly 105 may comprise drill string 106 and bottom hole assembly (BHA) 107. The drill string 106 may comprise a plurality of segments threadedly connected. The BHA 107 may comprise a drill bit 109, a measurement-while-drilling (MWD) apparatus 108 and a steering assembly 114. The steering assembly 114 may control the direction in which the borehole 104 is being drilled. As will be appreciated by one of ordinary skill in the art in view of this disclosure, the borehole 104 will be drilled in the direction perpendicular to the tool face 110 of the drill bit 109, which corresponds to the longitudinal axis 116 of the drill bit 109. Accordingly, controlling the direction of the borehole 104 may include controlling the angle between the longitudinal axis 116 of the drill bit 109 and longitudinal axis 115 of the steering assembly 114, and controlling the angular orientation of the drill bit 109 relative to the formation 103.

According to aspects of the present disclosure that will be described below, the steering assembly 114 may include an offset mandrel (not shown) that causes the longitudinal axis 116 of the drill bit 109 to deviate from the longitudinal axis 115 of the steering assembly 114. The offset mandrel may be counter-rotated relative to the rotation of the drill string 106 to maintain an angular orientation of the drill bit 109 relative to the formation 103. The steering assembly 114 may receive control signals from a control unit 113. The control unit 113 may comprise an information handling system with a processor and a memory device, and may communicate with the steering assembly 114 via a telemetry system. In certain embodiments, as will be described below, the control unit 113 may transmit control signals to the steering assembly 114 to alter the longitudinal axis 115 of the drill bit 109 as well as to control counter-rotation of portions of the offset mandrel to maintain the angular orientation of the drill bit 109 relative to formation 103. As used herein, maintaining the angular orientation of a drill bit relative to formation 103 may be referred to as maintaining the drill bit in a "geo-stationary" position. In certain embodiments, a processor and memory device may be located within the steering assembly 114 to perform some or all of the control functions. Moreover, other BHA 107 components, including the MWD apparatus 108, may communicate with and receive instructions from control unit 113.

In certain embodiments, the drill string 106 may be rotated to drill the borehole 104. The rotation of the drill string 106 may in turn rotate the BHA 107 and drill bit 109 with the same rotational direction and speed. The rotation may cause the steering assembly 114 to rotate about its longitudinal axis 115, and the drill bit 109 to rotate around its longitudinal axis 116 and the longitudinal axis 115 of the steering assembly 114. The rotation of the drill bit 109 about its longitudinal axis 116 is desired to cause the drill bit 109 to cut into the formation, but the rotation of the drill bit 109 about the longitudinal axis 115 of the steering assembly 114 may be undesired in certain instances, as it changes the angular orientation of the drill bit 109 relative formation 103. For example, when the longitudinal axis 116 of the drill bit 109 is at an angle from the longitudinal axis of the drill string 115, as it is in FIG. 1, the drill bit 109 may rotate about the longitudinal axis 115 of the steering assembly 114, preventing the drilling assembly from drilling at a particular angle and direction.

Figure 2A:
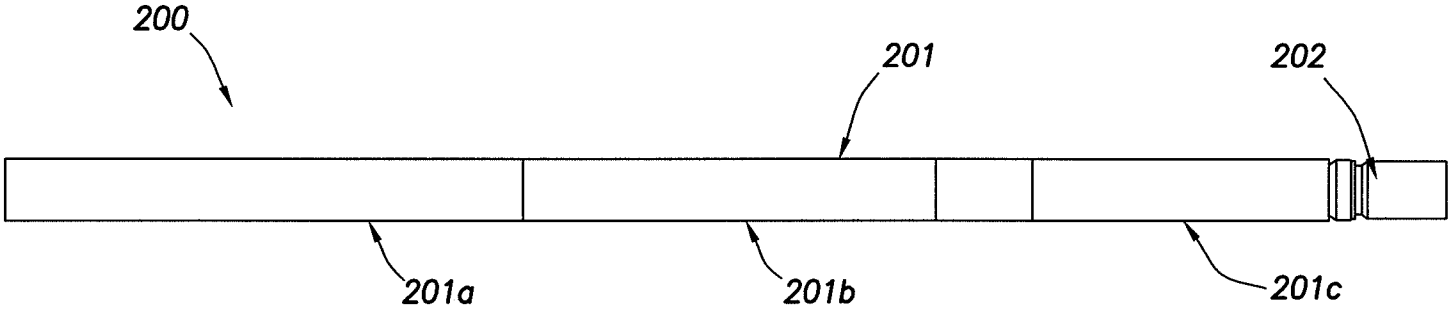
Figure 2B:
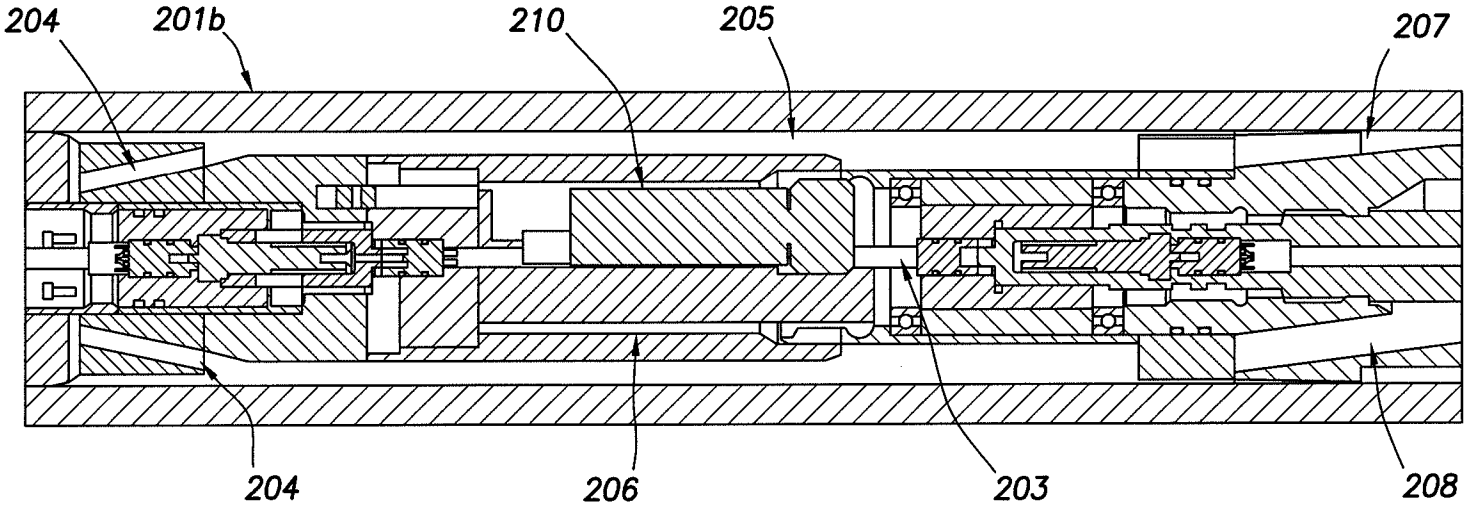
Figure 2C:
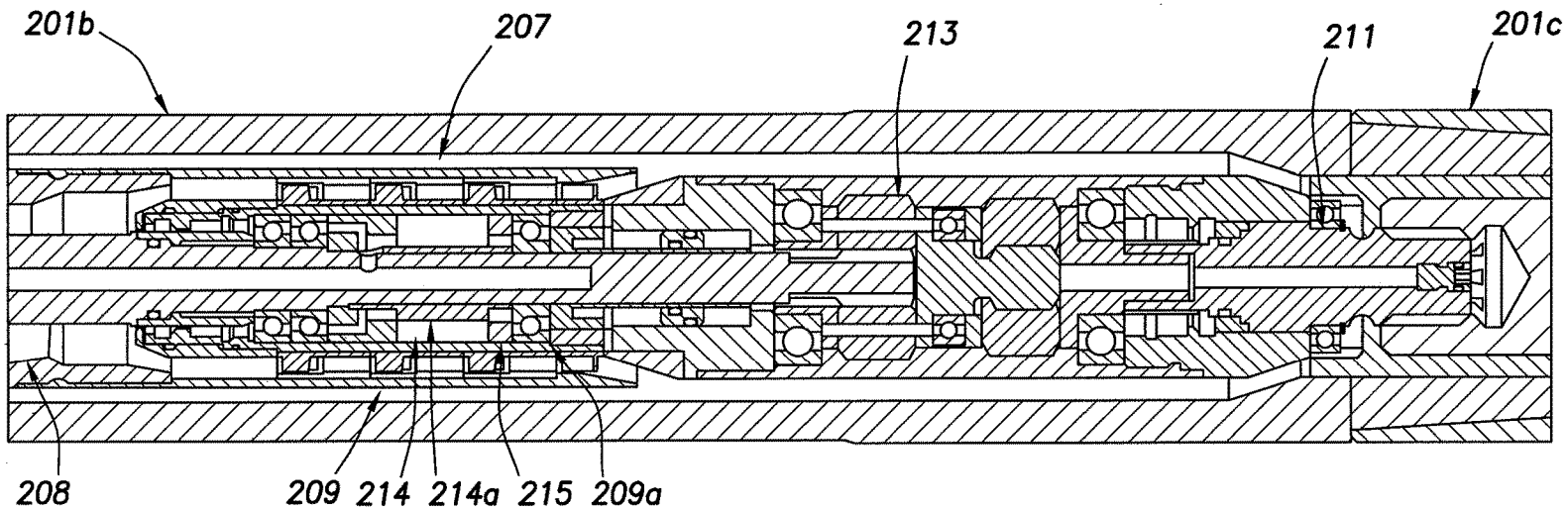
Figure 2D:
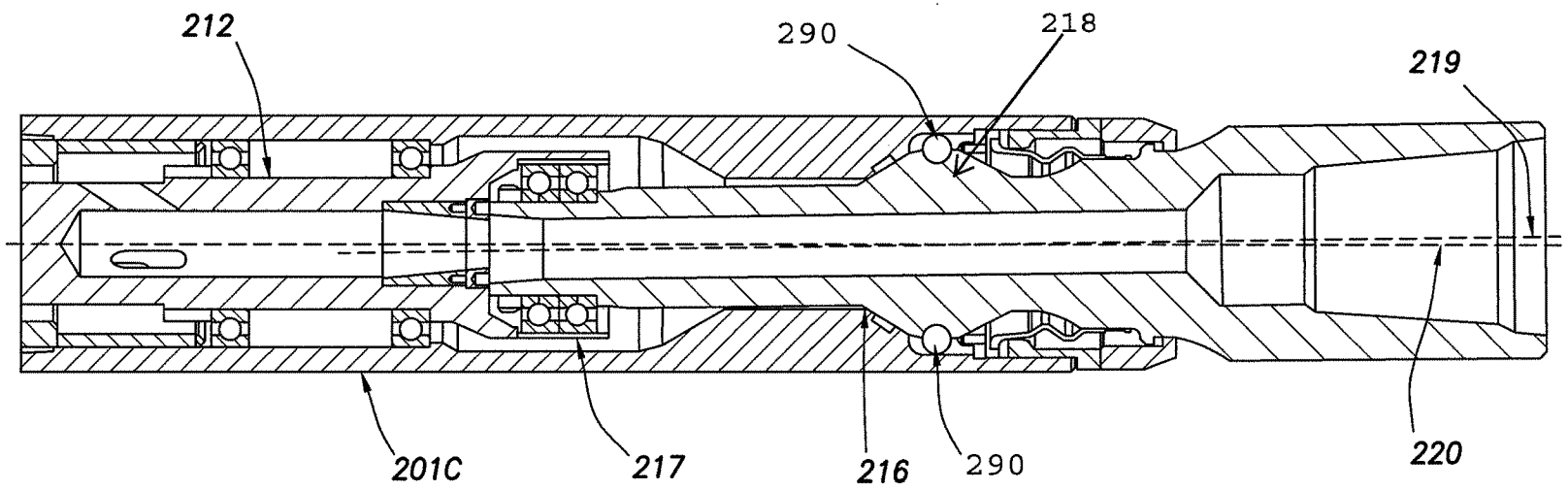

FIGS. 2A-D are diagrams illustrating an example steering assembly 200, according to aspects of the present disclosure, that may be used, in part, to maintain a drill bit in a geo-stationary position during drilling operations. FIGS. 2B-D depict illustrative portions of the steering assembly 200. As will be described below, the steering assembly 200 may include a housing 201 that may be coupled directly to a drill string or indirectly to a drill string, such as through a MWD apparatus. The housing 201 may comprise separate segments 201*a-c*, or may comprise a single unitary housing. In certain embodiments, as will be described below, each of the segments may correspond to a separate instrument portion of the steering assembly 200. For example, section 201*a* may house the control mechanisms, and may communicate with a control unit at the surface and/or receive control signals from the surface and control mechanisms within the steering assembly. In certain embodiments, the control mechanisms may comprise a processor and a memory device, and may receive measurements from position sensors within the steering assembly, such as gravity toolface sensors that may indicate a drilling direction. Section 201*b* may comprise drive elements, including a variable flow pathway and a flow-controlled drive mechanism. Section 201*c* may comprise steering elements that control the drilling angle and axial orientation of a drill bit coupled to bit shaft 202 of the steering assembly 200.

In certain embodiments, the steering assembly 200 may be coupled, directly or indirectly, to a drill string, through which drilling fluid may be pumped during drilling operations. The drilling fluid may flow through ports 204 into an annulus 205 around a flow control module 206. Once in the annulus 205, the drilling fluid may either flow to an inner annulus 208, in fluid communication with a fluid-controlled drive mechanism 209, or may be diverted to a bypass annulus 207. A flow control valve 210 may be included within the flow control module 206 and may control the amount/flow of drilling fluid that enters the inner annulus 208 to drive the fluid-controlled drive mechanism 209.

In certain embodiments, the fluid pathway from port 204 to inner annulus 208 may comprise a variable flow fluid pathway 203, with the fluid-controlled drive mechanism 209 being in fluid communication with the variable flow fluid pathway 203 via inner annulus 208. The flow control valve 210 may be disposed within the variable flow fluid pathway 203, and configured to vary or change the fluid flow through the variable flow fluid pathway 203. According to aspects of the present disclosure, the rotational speed of the fluid-controlled drive mechanism 209 may be controlled by the amount and rate of drilling fluid that flows into the inner annulus 208. In certain embodiments, the flow control valve 210, therefore, may be used to control the rotational speed of the fluid-controlled drive mechanism 209 by varying the amount or rate of drilling fluid that flows into the inner annulus 208. As would be appreciated by one of ordinary skill in the art in view of this disclosure, other variable flow fluid pathways are possible, using a variety of valve configurations that may meter the flow of drilling fluid across a fluid-controlled drive mechanism.

As described above, the steering assembly 200 may comprise a fluid-controlled drive mechanism 209 in fluid communication with the variable flow fluid pathway 203 via the inner annulus 208. In the embodiment shown, the fluid-controlled drive mechanism 209 comprises a turbine, but other fluid-controlled drive mechanisms are possible, including but not limited to a mud motor. The turbine 209 may comprise a plurality of rotors and stators that generate rotational movement in response to fluid flow within the inner annulus 208. The turbine 209 may generate rotation at an output shaft 211, which may be coupled, directly or indirectly, to an offset mandrel 212. In the embodiment shown, a speed reducer 213 may be placed between the turbine 209 and the output shaft 211 to reduce the rate of rotation generated by the turbine 209.

In certain embodiments, a generator 214 may be coupled to the fluid-controlled drive mechanism 209. In the embodiment shown, the generator 214 may be magnetically coupled to a rotor 209*a* of the turbine 209. The generator 214 may comprise a wired stator 214*a*. The wired stator 214*a* may be magnetically coupled to a rotor 209*a* of the rotor 209 via magnets 215 coupled to the rotor 209*a*. As the turbine 209 rotates, so does the rotor 209*a*, which may cause the magnets 215 to rotate around the wired stator 214*a*. This may generate an electrical current within the generator 214, which may be used to power a variety of control mechanisms and sensors located within the steering assembly 200, including control mechanisms within segment 201*a*.

The output shaft 211 may be coupled, directly or indirectly, to an offset mandrel 212. The output shaft 211 may impart rotation from the turbine 209 to the offset mandrel 212, such that the offset mandrel 212 may be rotated independently from the housing 201. The offset mandrel 212 may be coupled to the output shaft 211 at a first end and may comprise an eccentric receptacle 217 at a second end. The bit shaft 216 may be at least partially disposed within the eccentric receptacle 217. The eccentric receptacle 217 may be used to alter or maintain a longitudinal axis 219 of the bit shaft 216 and a drill bit (not shown) coupled to the bit shaft 216.

The bit shaft 216 may be pivotally coupled to the housing 201 at pivot point 218. As can be seen, the bit shaft 216 may pivot about the pivot point 218 to alter a longitudinal axis 219 of the bit shaft 216. In certain embodiments, the eccentric receptacle 217 may cause the bit shaft 216 to pivot about pivot point 218, which may offset the longitudinal axis 219 of the bit shaft 216 relative to the longitudinal axis 220 of the steering assembly 200. In addition to allowing the bit shaft 216 to pivot relative to the housing 201, the pivot point 218 may also be used to impart torque from the housing 201 to the bit shaft 216. The torque may be imparted to a drill bit (not shown) that is coupled to the bit shaft 216 and that may share the longitudinal axis 219 of the bit shaft 216. The longitudinal axis 219 of the bit shaft 216 may therefore correspond to a drilling angle of the steering assembly 200.

During drilling operations, a drill string coupled to the housing 201 may be rotated, causing the housing 201 to rotate around the longitudinal axis 220. The rotation of the housing 201 may be imparted to the bit shaft 216 as torque through pivot point 218 using balls 290. The torque may cause the bit shaft 216 to rotate about its longitudinal axis 219 as well as the longitudinal axis 220 of the steering assembly 200. When the longitudinal axis 219 of the bit shaft 216 is offset relative to the longitudinal axis 220 of the steering assembly 200, this may cause the end of the bit shaft 216 to rotate with respect to the longitudinal axis 220, changing the angular direction of the bit shaft 216 and corresponding bit with respect to the surrounding formation.

In certain embodiments, the offset mandrel 212 may be counter-rotated relative to the housing 201 to maintain the angular orientation of the bit shaft 216. For example, a drill string may be rotated in a first direction at a first speed, causing the steering assembly 200 to rotate at the first direction and the first speed. To maintain the angular orientation of the bit shaft 216 with respect to the surrounding formation, the variable flow pathway 203 may be controlled to allow a flow of drilling fluid across the fluid-controlled drive mechanism 209 such that the offset mandrel 212 is rotated in a second direction, opposite the first direction, at a second speed, the same as the first speed. Notably, with the offset mandrel 212 rotating opposite the housing 201 at the same speed, the eccentric end 217 of the offset mandrel 212 may remain stationary with respect to the surrounding formation (geo-stationary), maintaining the angular orientation of the bit shaft 216 relative to the formation while still allowing the bit shaft 216 to rotate about its longitudinal axis 219. Likewise, the angular orientation of the bit shaft 216 may be altered relative to the surrounding formation by rotating the offset mandrel 212 at any other speed than the rotational speed of the housing 201.

FIGS. 3A-C are diagrams illustrating another example steering assembly 300 according to aspects of the present disclosure. FIGS. 3B and 3C illustrate selected portions of the steering assembly 300. As will be described below, steering assembly 300 may allow for a drilling angle to be varied by altering a longitudinal axis of a bit shaft relative to the longitudinal axis of steering assembly. This is in contrast to steering assembly 200, where the longitudinal axis 219 of the bit shaft 216 may be fixed relative to the longitudinal axis 220 by the configuration of the eccentric end 217 of the offset mandrel 212.

The steering assembly 300 may comprise a housing 301, which may comprise segments 301*a-d*. The housing 301 may also comprise a single unitary structure. Like the steering assembly 200, the steering assembly 300 may comprise a section 301*a* containing control mechanisms, a section 301*b* containing drive mechanisms, and a segment 301*d* containing steering mechanisms. The steering assembly 301 also comprises a segment 301*c* that contains a drilling angle control mechanism, which will be described below.

In certain embodiments, the steering assembly 300 may comprise a similar fluid-controlled drive mechanism (not shown) to the turbine 209 in steering assembly 200. Likewise, the fluid-controlled drive mechanism may drive an output shaft (not shown) that may be coupled to an offset mandrel 303, and allow the offset mandrel 303 to be independently rotated with respect to the housing 301. Unlike the steering assembly 200, where the output shaft 211 of the turbine 209 is directly coupled to the offset mandrel 212, an offset mandrel 303 of the steering assembly 300 may be indirectly coupled to an output shaft of the turbine via a drilling angle control mechanism 302. As will be described below, the drilling angle control mechanism 302 may impart torque from a fluid-controlled drive mechanism to the offset mandrel 303, while controlling the longitudinal axis of a bit shaft 304 coupled to the offset mandrel 303.

In the embodiment shown, the offset mandrel 303 may be at least partially disposed within an eccentric cam 305. The offset mandrel 303 and eccentric cam 305 may both be coupled indirectly to an output shaft of a fluid-controlled drive mechanism via the drilling angle control mechanism 302, such that the fluid-controlled drive mechanism may cause the offset mandrel 303 and eccentric cam 305 to rotate together, independently from the housing 301. The offset mandrel 303 may have an eccentric receptacle 306 in which an end of bit shaft 304 is disposed. As in steering assembly 200 from FIG. 2, the eccentric receptacle 306 may cause an offset in a longitudinal axis 309 of the bit shaft 304 relative to a longitudinal axis 380 of the steering assembly 300. The eccentric cam 305 also may include an eccentric portion 307 in which a portion of the offset mandrel 303 is disposed and by which a longitudinal axis 308 of the offset mandrel 303 may be offset from the longitudinal axis of the steering assembly 300.

As will be appreciated by one of ordinary skill in the art in view of this disclosure, rotating the offset mandrel 303 independently with respect to the eccentric cam 305 may allow for the longitudinal axis 309 of the bit shaft 304 to be varied, which varies a drilling angle of the steering assembly 300. The eccentric receptacle 306, for example, may be configured to cause a 10° fixed offset in the longitudinal axis 309 of the bit shaft 304 relative to the longitudinal axis of the steering assembly 300. Likewise, the eccentric cam 306, for example, may be configured to cause a 10° fixed offset in the longitudinal axis 308 of the offset mandrel 303 relative to the longitudinal axis of the steering assembly 300. By rotating the offset mandrel 303 with respect to the eccentric cam 305, the offsets may interact constructively or destructively to vary the longitudinal axis 309 of the bit shaft 304 (and therefore the drilling angle) between 0° (parallel with the steering assembly 300) and 20°. The angular variations and amounts described above are not meant to be limiting, but are merely illustrative of aspects of the present disclosure.

In the embodiment shown, the drilling angle control mechanism 302 may comprise an electric motor 310 coupled to the offset mandrel 303. Notably, the output of the electric motor 310 may be configured to rotate the offset mandrel 303 independently from the eccentric cam 305, such that the drilling angle of the steering assembly 300 may be altered. The drilling angle control mechanism 302 may further comprise a power storage element 311, which may be coupled to and receive power from a generator (not shown) coupled to the fluid-controlled drive mechanism. Additionally, the drilling angle control mechanism 302 may also receive or generate control signals to control the electric motor 310 and the drilling angle of the steering assembly 300. Once the drilling angle has been set, the electric motor 310 may maintain the rotational orientation of the offset mandrel 303 with respect to the eccentric cam 305, such that the offset mandrel 303 and the eccentric cam may be rotated together by the fluid-controlled drive mechanism to maintain the bit shaft 304 in a geo-stationary position.

According to aspects of the present disclosure, an example method for controlling the direction of a drilling assembly within a borehole may comprise positioning a steering assembly within a borehole. The steering assembly may comprise a housing, a variable flow fluid pathway disposed within the housing, a fluid-controlled drive mechanism in fluid communication with the variable flow fluid pathway; and an offset mandrel coupled to the fluid-controlled drive mechanism. The steering assembly may be the same as or similar to the steering assemblies 200 and 300 described above. The method may include rotating the offset mandrel independently from the housing, and varying a rotational speed of the offset mandrel by altering the variable flow fluid pathway. In certain embodiments, altering the variable flow fluid pathway may comprise changing a fluid flow through the variable flow fluid pathway using a flow control valve In certain embodiment of the example method, the steering assembly may further comprise a bit shaft pivotably coupled to the housing. The bit shaft may be partially disposed in an eccentric receptacle of the offset mandrel. Additionally, the housing may be configured to impart torque on the bit shaft. Moreover, the fluid controlled drive mechanism may comprise one of a turbine and a mud motor, and the steering assembly may further comprise a generator coupled to the fluid-controlled drive mechanism.

In certain embodiment of the above method, the offset mandrel may be at least partially disposed within an eccentric cam. And the eccentric cam may be coupled to the output of the fluid controlled drive mechanism. Additionally, the offset mandrel may be coupled to an electric motor that is configured to rotate the offset mandrel independently from the eccentric cam. As is described above, the electric motor may rotate the offset mandrel with respect to the eccentric cam to alter a drilling angle of the steering assembly.

According to aspects of the present disclosure, another example method for controlling the direction of a drilling assembly within a borehole may comprise positioning a steering assembly within a borehole, wherein the steering assembly comprises an offset mandrel coupled to a bit shaft. The steering assembly, offset mandrel and bit shaft may be the same as or similar to the ones described above with respect to FIGS. 2A-2D and 3A-3C. The method may also include rotating the offset mandrel with an electric motor coupled to offset mandrel. Rotating the offset mandrel with the electric motor may alter a longitudinal axis of the bit shaft. The method may also include changing a rotational speed of the offset mandrel by altering a variable flow fluid pathway in fluid communication with the fluid-controlled drive mechanism. The variable flow fluid pathway may include a flow control valve.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces. Additionally, the terms "couple" or "coupled" or any common variation as used in the detailed description or claims are not intended to be limited to a direct coupling. Rather two elements may be coupled indirectly and still be considered coupled within the scope of the detailed description and claims.

What is claimed is:

1. A system for controlling the direction of a drilling assembly within a borehole, comprising:

a port in fluid communication with an annulus, wherein the port directs a fluid around a flow control module;

an inner annulus in fluid communication with the annulus;

a flow control valve of the flow control module in fluid communication with the inner annulus;

a housing;

a variable flow fluid pathway within the housing from the port to the inner annulus, wherein the flow control valve varies a flow of the fluid through the variable flow fluid pathway;

a fluid-controlled drive mechanism in fluid communication with the variable flow fluid pathway, wherein the fluid-controlled drive mechanism is driven by the flow of the fluid to the inner annulus;

offset mandrel coupled to an output of the fluid-controlled drive mechanism; and an output shaft coupled to the offset mandrel, wherein the output shaft imparts rotation from the fluid-controlled drive mechanism to the offset mandrel such that the offset mandrel is independently rotatable with respect to the housing.

2. The system of claim 1, further comprising a bit shaft pivotably coupled to the housing, wherein:

the bit shaft is partially disposed in an eccentric receptacle of the offset mandrel; and the housing is configured to impart torque on the bit shaft.

3. The system of claim 2, wherein the variable flow fluid pathway comprises a flow control valve configured to vary the fluid flow through the variable flow fluid pathway.

4. The system of claim 2, wherein the fluid-controlled drive mechanism comprises one of a turbine and a mud motor.

5. The system of claim 3, further comprising a generator coupled to the fluid-controlled drive mechanism.

6. The system of claim 1, wherein:

the offset mandrel is at least partially disposed within an eccentric cam, the eccentric cam is coupled to the output of the fluid-controlled drive mechanism.

7. A method for controlling the direction of a drilling assembly within a borehole, comprising:

positioning a steering assembly within a borehole, wherein the steering assembly comprises:

a housing;

a variable flow fluid pathway disposed within the housing from a port to an inner annulus in fluid communication with an annulus of the drilling assembly;

a fluid-controlled drive mechanism in fluid communication with the variable flow fluid pathway, wherein the fluid-controlled drive mechanism is driven by flow of a fluid to the inner annulus; and an offset mandrel coupled to the fluid-controlled drive mechanism and an output shaft;

flowing the fluid through the port in fluid communication with the annulus, wherein the port directs a fluid around a flow control module;

rotating the offset mandrel independently from the housing by imparting, by the output shaft, a rotation from the fluid-controlled drive mechanism to the offset mandrel; and varying a rotational speed of the offset mandrel by altering the variable flow fluid pathway using a flow control valve of the flow control module to vary the flow of the fluid through the variable flow fluid pathway, wherein the flow control module is in fluid communication with the inner annulus.

8. The method of claim 7 wherein:

the steering assembly further comprises a bit shaft pivotably coupled to the housing;

the bit shaft is partially disposed in an eccentric receptacle of the offset mandrel; and the housing is configured to impart torque on the bit shaft.

9. The method of claim 8, wherein the fluid-controlled drive mechanism comprises one of a turbine and a mud motor.

10. The method of claim 8, wherein the steering assembly further comprises a generator coupled to the fluid-controlled drive mechanism.

11. The method of claim 7, wherein:

the offset mandrel is at least partially disposed within an eccentric cam, the eccentric cam is coupled to the output of the fluid-controlled drive mechanism.

12. The method of claim 11, wherein:

the offset mandrel is coupled to an electric motor; and the electric motor is configured to rotate the offset mandrel independently from the eccentric cam.

13. The method of claim 12, further comprising altering a drilling angle of the steering assembly by rotating the offset mandrel with respect to the eccentric cam.

14. The method for controlling the direction of a drilling assembly within a borehole, comprising:

positioning a steering assembly within a borehole, wherein the steering assembly comprises an offset mandrel coupled to a bit shaft;

rotating the offset mandrel with an electric motor coupled to offset mandrel;

rotating the offset mandrel using a fluid-controlled drive mechanism, wherein an offset shaft imparts rotation from a fluid-controlled drive mechanism coupled to the offset mandrel such that the offset mandrel rotates independently from a housing of the drilling assembly; and changing a rotational speed of the offset mandrel by altering a variable flow fluid pathway within a housing from a port to an inner annulus by changing flow of a fluid using a flow control valve of the variable flow fluid pathway, wherein the flow control valve is in fluid communication with the inner annulus, wherein the inner annulus is in fluid communication with an annulus, wherein the annulus is in fluid communication with a port of the housing, wherein the port directs the fluid around a flow control module, and wherein the variable fluid flow pathway is in fluid communication with the fluid-controlled drive mechanism.

15. The method of claim 14, wherein rotating the offset mandrel with the electric motor alters a longitudinal axis of the bit shaft.

16. The method of claim 15, wherein the longitudinal axis of the bit shaft corresponds to a drilling angle of the drilling apparatus.

17. The method of claim 14, wherein the variable flow fluid pathway comprises a flow control valve.

18. The method of claim 14, wherein the fluid-controlled drive mechanism comprises one of a turbine and a mud motor.

* * * * *